United States Patent [19]

Carter

[11] Patent Number: 4,607,656

[45] Date of Patent: Aug. 26, 1986

[54] QUICK ERECTION COLLAPSIBLE SHELTER

[76] Inventor: Mark C. Carter, 210 Pason, San Dimas, Calif. 91773

[21] Appl. No.: 535,426

[22] Filed: Sep. 26, 1983

[51] Int. Cl.[4] ..... E04B 7/16; A45F 1/16

[52] U.S. Cl. ..... 135/110; 52/109

[58] Field of Search ..... 135/106, 107, 108, 109, 135/110, 111, 112, 113; 52/109

[56] References Cited

U.S. PATENT DOCUMENTS

| | | | |
|---|---|---|---|
| 684,130 | 10/1901 | Taubert | 135/110 |
| 1,326,006 | 12/1919 | Sterhardt | 135/111 X |
| 1,493,915 | 5/1924 | Baker | 135/109 |
| 1,712,836 | 5/1929 | Mills | 135/110 |
| 1,728,356 | 9/1929 | Morgan | 135/109 |
| 1,853,367 | 4/1932 | Mace | 135/110 |
| 3,174,397 | 3/1965 | Sanborn | 52/109 X |
| 3,199,518 | 8/1965 | Glidewell | 135/109 |
| 3,335,815 | 8/1967 | Oakes | 52/109 X |
| 3,375,624 | 4/1968 | Mikulin | 52/109 |
| 3,496,687 | 2/1970 | Greenberg et al. | 52/109 |
| 3,526,066 | 9/1970 | Hagar et al. | 52/109 X |
| 4,156,433 | 5/1979 | Beaulieu | 135/110 X |

FOREIGN PATENT DOCUMENTS

| | | | |
|---|---|---|---|
| 1434526 | 12/1968 | Fed. Rep. of Germany | 52/109 |
| 823693 | 10/1937 | France | 135/109 |
| 692885 | 8/1965 | Italy | 135/106 |
| 198803 | 6/1923 | United Kingdom | 135/111 |
| 672815 | 5/1952 | United Kingdom | 135/110 |

*Primary Examiner*—Richard J. Johnson

*Attorney, Agent, or Firm*—Boniard I. Brown

[57] ABSTRACT

A quick-erect collapsible shelter having four or more telescoping legs, connected by a framework which includes pluralities of X-shaped linkages and a slider on each leg to provide interconnecting truss between the legs and support for a covering canopy.

21 Claims, 10 Drawing Figures

QUICK ERECTION COLLAPSIBLE SHELTER

BACKGROUND OF THE INVENTION

Various canopy supports, some including X-shaped truss are known in the prior art. Typical examples are shown in U.S. Pat. Nos. 136,456, 255,093, 306,011, 754,613, 775,263, 905,768, 927,738, 1,326,006, 1,652,581, 1,912,425 and 3,199,518. Most suffer either by having a major dimension present when expanded which is also present when contracted, being so flimsy that the rigors of weather and other environmental effects can not be withstood, or being so complex that production cannot be accomplished at a reasonable cost.

BRIEF DESCRIPTION OF THE PRESENT INVENTION

The present shelter includes a canopy and structural support for the canopy. The structural support includes a plurality of telescoping legs capable of being extended about twice their stowed length. These legs are supported vertical to the ground by a connecting truss structure comprised of multiple pairs of X-shaped truss assemblies. Each assembly includes a pair of structural members which are pivoted together at a midpoint to form an X and are pivotally connected to another pair of pivotally connected members at inner ends thereof. The upper, outer ends of the structural members of each pair are connected pivotally directly to a leg while the resultant lower ends are connected pivotally to a slider member which slides over the leg from a position fixable by suitable retainers extending the members to a position relatively remote from the end fixed to the leg so that the volume subtended by the extremities of the resultant structure is greatly reduced. In addition, intermediate canopy supports may be provided by similar truss assembly extending from the inner connections of leg connecting truss assemblies.

Therefore it is an object of the invention to provide a collapsible shelter which when collapsed has no dimension much larger than half of that dimension when erected.

Another object is to provide a collapsible shelter which uses two basic assemblies over and over for production economies.

Another object is to provide a collapsible shelter which is easily erected and collapsed, can be constructed of lightweight materials and can withstand the rigors of a vigorous environment.

These and other objects and advantages of the present invention will become apparent to those skilled in the art after considering the following detailed specification together with the accompanying drawings wherein:

DETAILED DESCRIPTION OF THE SHOWN EMBODIMENTS

Figure 1:
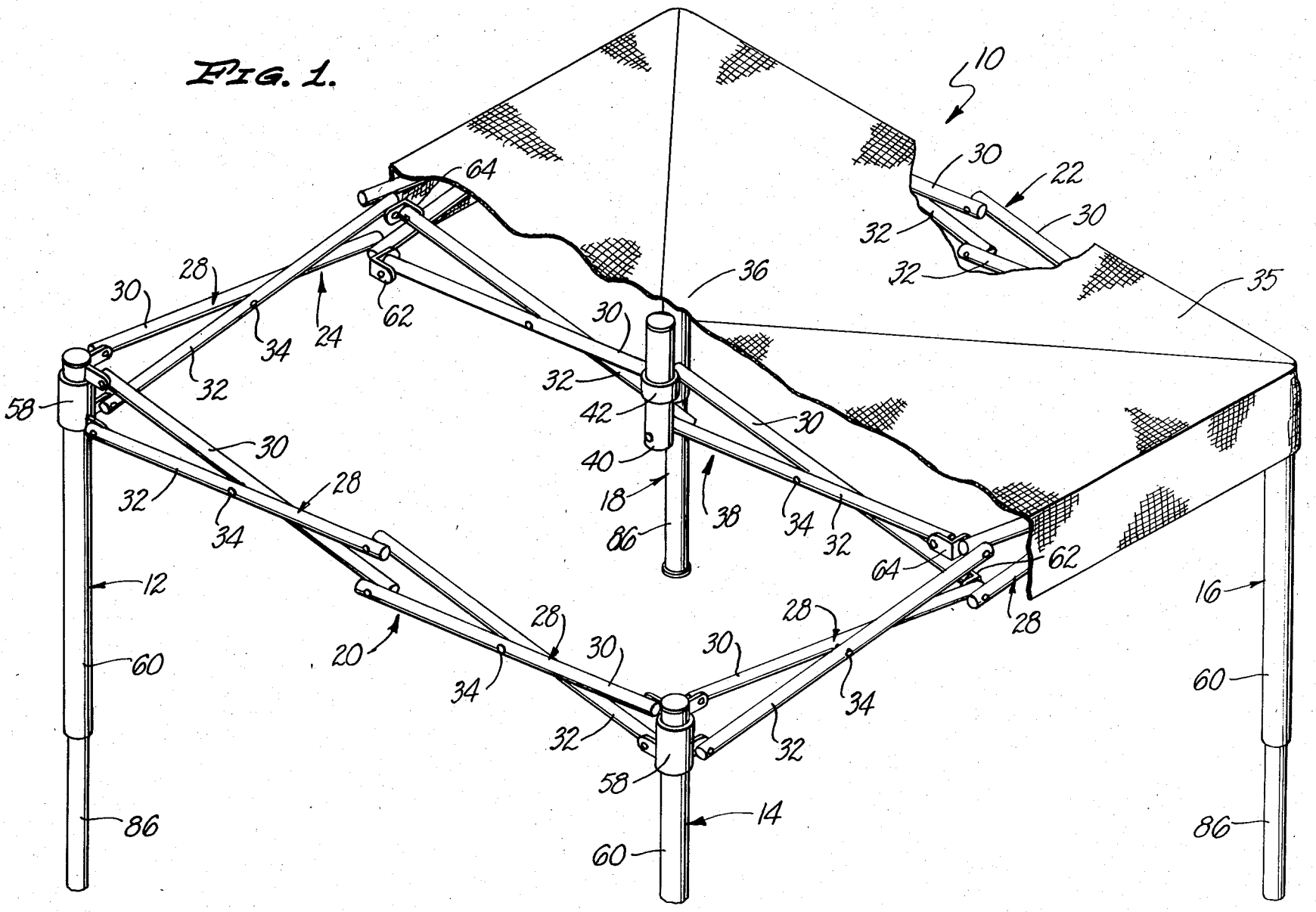
FIG. 1 is a cutaway perspective view of a shelter constructed according to the present invention.
Figure 2:
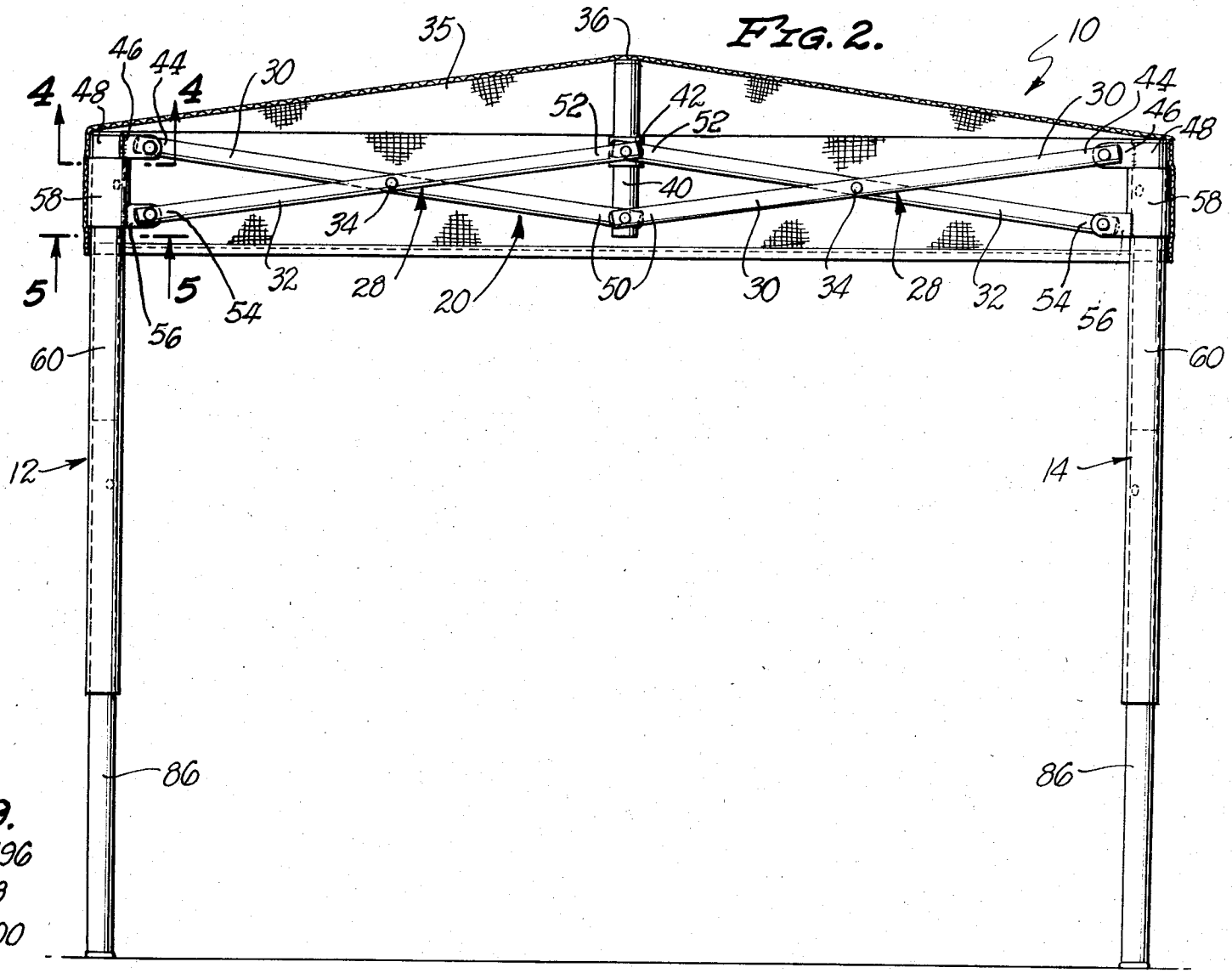
FIG. 2 is a side elevational view partially in cross section of the shelter of FIG. 1.
Figure 3:
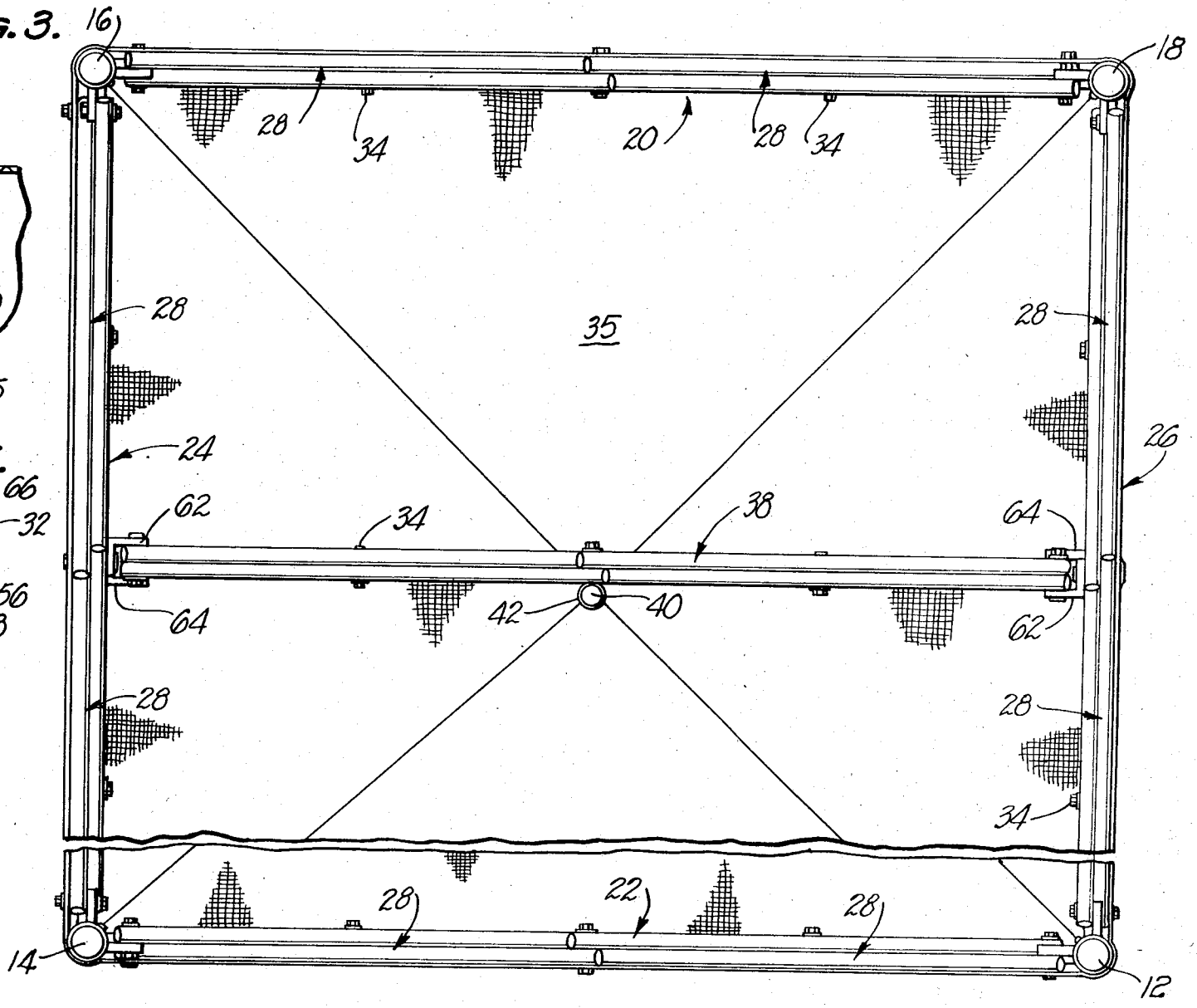
FIG. 3 is a bottom view of the shelter shown in FIGS. 1 and 2.

Referring to the drawings more particularly by reference numbers, number 10 in FIG. 1 refers to a collapsible shelter constructed according to the present invention. The shelter includes telescoping legs 12, 14, 16 and 18. The legs 12, 14, 16 and 18 are restrained to remain parallel and connected by side pairs 20 and 22 and end pairs 24 and 26 of essentially identical X-shaped collapsible truss 28 which each include two structural members 30 and 32 which are connected together by a central pivot 34. These pairs 20, 22, 24 and 26 when extended to the position shown in FIG. 1 provide support for a canopy 35 stretched thereacross. The canopy 35 may be supported in its central portion 36 by a center pair 38 of truss 28 which extends centrally across the shelter 10 connecting between side pair 24 and 26 to gain support therefrom. The center pair 38 include an upwardly extending central support 40 pivotally connected to the members 32 and slidedly connected to the members 30 by means of a sliding collar 42. As shown with respect to side pair 20 in FIG. 2, the members 30 each have an outer end 44 pivoted to a flange 46 connected to the upper end 48 of the leg 12 or 14. The inner ends 50 of the members 30 are pivotally connected together thereby connecting adjacent legs. Stiffening support and control of erection is provided by members 32. The members 32 are connected by the pivot 34 to the member 30 of their truss 28. Their inner ends 52 are pivotally connected together while each outer end 54 is connected to a flange 56 on a leg slider 58 which is shaped in size to slide over the outer member 60 of a collapsible leg. When the slider 58 is positioned as shown in FIGS. 1, 2 and 3 on the outer member 60, the shelter 10 is in an erected position.

Figure 4:
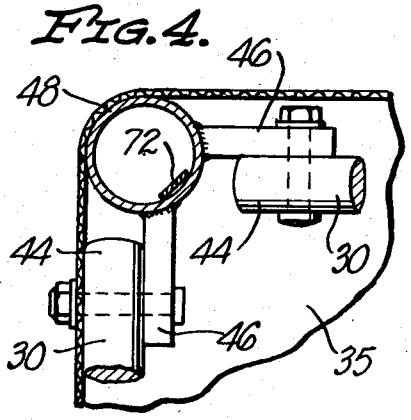
FIG. 4 is an enlarged detailed cross-sectional view taken on line 4—4 of FIG. 2.
Figure 5:
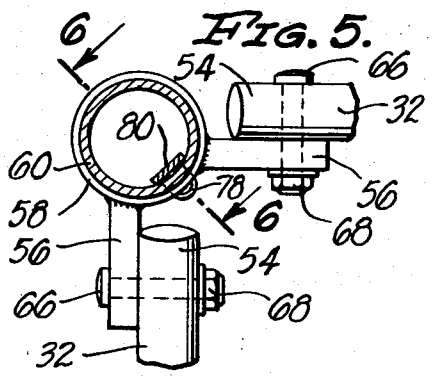
FIG. 5 is an enlarged detailed cross-sectional view taken on line 5—5 of FIG. 2.

The center pair 38 of truss 28 are connected together in a similar manner except that the outer ends 44 and 54 of the members 30 and 32 comprising the center pair 38 are connected to flanges 62 and 64 which connect at the pivots at the ends 52 and 50 respectively of the side pairs. As shown in FIGS. 4 and 5, the pivots between the flanges 46 and 56 are provided by means of suitable fasteners such as bolts 66 and connecting nuts 68.

Figure 6:
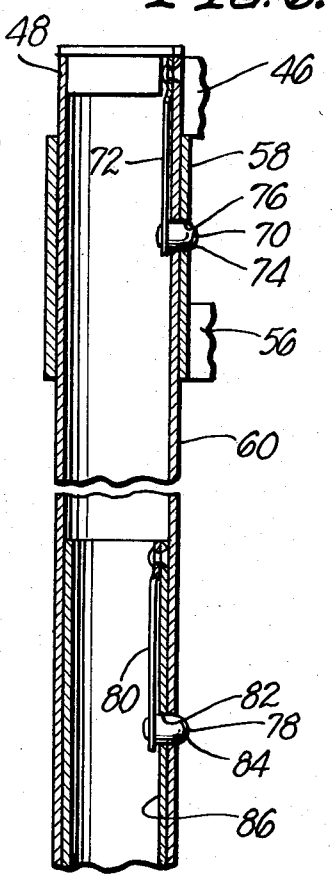
FIG. 6 is an enlarged detailed cross-sectional view taken on line 6—6 in FIG. 5.
Figure 7:
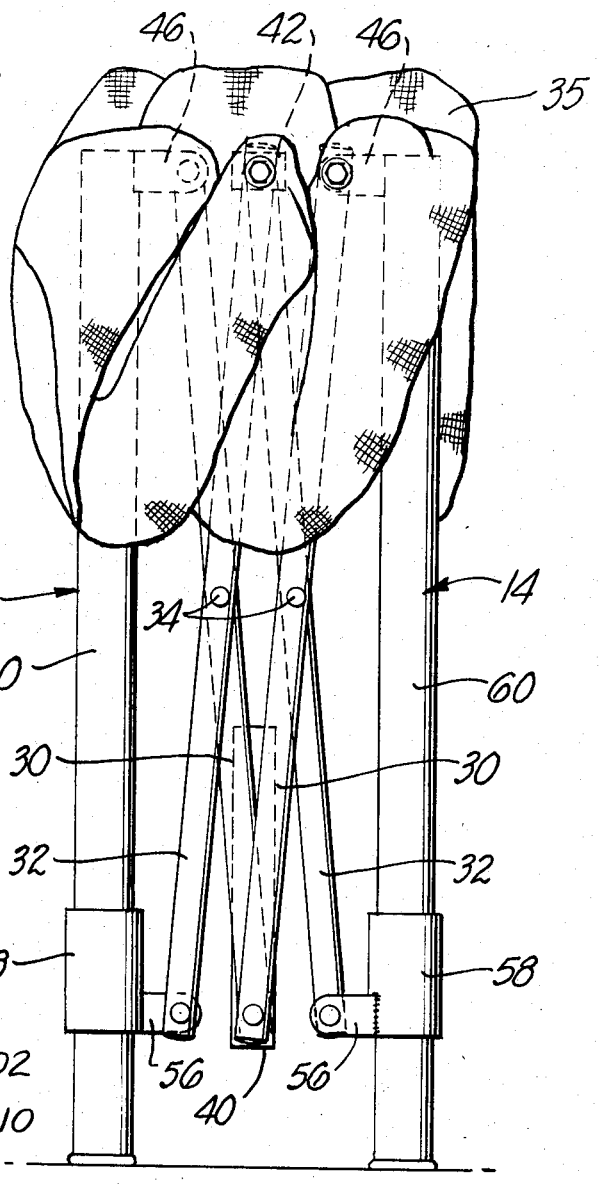
FIG. 7 is a side elevational view of the structure of FIG. 1 in a collapsed condition.

As shown in FIG. 6, the slider 58 can be maintained in its shelter erecting condition by means of abutment button 70 which is biased by means of a leaf spring 72 through a hole 74 in a leg upper end 48 and through a mating hole 76 on the slider 58. When the button 70 is maintained in both holes 74 and 76, the slider 58 is constrained from movement to assure that the shelter 10 stays erected. A similar button 78 biased by a spring 80 extends through mating holes 82 and 84 in the inner and outer members 86 and 60 forming each leg. When the button 78 is positioned through the holes 82 and 84 the members 60 and 86 of each collapsible leg are constrained to remain extended. By depressing the buttons 76 and 78 the shelter 10 can be collapsed and its legs 12, 14, 16 and 18 be retracted to greatly reduce the size of the shelter 10 for storage. This is shown in FIG. 7 wherein the shelter 10 has been collapsed.

Figure 8:
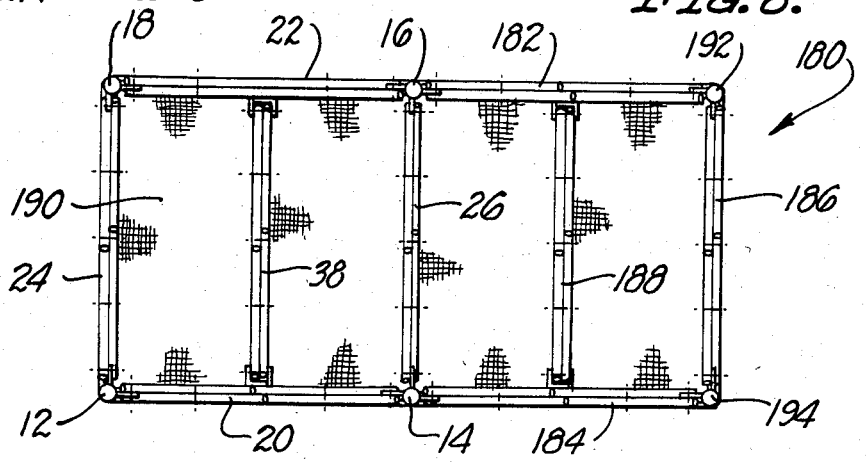
FIG. 8 is a modified embodiment of the shelter shown in FIG. 1 employing additional legs and truss assemblies.

Although heretofore the shelter 10 has been described with four legs, additional legs and side or end pairs of truss 28 can be added to enlarge the structure provided. A shelter 180 having additional side pairs 182 and 184, an additional end pair 186 and an additional center pair 188 as well as an enlarged canopy 190 and additional legs 192 and 194 is shown in FIG. 8. Since the present invention is essentially a modular design, the same truss 28 an legs can be used to assemble still further enlarged structures.

Figure 9:
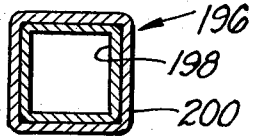
FIG. 9 is a cross-sectional view of a telescoping leg constructed from square channel rather than circular cross section tubing.
Figure 10:
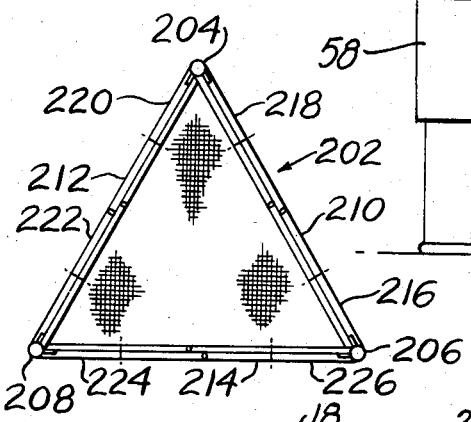
FIG. 10 is an underside view similar to FIG. 8 of a modified embodiment of the shelter employing at least three legs.

Another modification is shown in FIG. 9 wherein the leg 196 has inner and outer members 198 and 200 which have a square cross section rather than the circular cross section of the inner and outer leg members 86 and 60. A still further modification is shown in FIG. 10 wherein a shelter 202 employs at least three legs 204, 206 and 208 which are interconnected by pairs 210, 212 and 214 of X configured truss structures 216, 218, 220, and 222 and 224 and 226, similar to the x-shaped collapsible truss 28 described above.

Therefore, there has been shown and described a novel shelter which fulfills all the objects and advantages sought therefore. Many changes, modifications, variations and other uses and applications of the subject invention will, however, become apparent to those skilled in the art after considering the foregoing specification together with the accompanying drawings. All such changes, modifications, variations and other uses and applications which do not depart from the spirit and scope of the invention are deemed to be covered by the invention which is limited only by the claims which follow.

What is claimed is:

1. A collapsible shelter which can be quickly erected including:

at least four telescoping legs, each telescoping leg having:

an upper portion;

a slider member connected to said upper portion for sliding contact therewith; and a lower portion for engagement with the ground, said lower portion being slideably mounted to said upper portion;

at least four pairs of X configured truss structures, each X configured truss structure of each pair of X configured truss structures having:

a first link having:

an outer end pivotally connected to a leg upper portion;

a center portion; and an inner end pivotally connected to an inner end of said first link inner end of another X configured truss structure of the pair; and a second link having:

an outer end pivotally connected to a slider member;

a center portion pivotally connected to said center portion of said first link of said X configured truss structure; and an inner end pivotally connected to an inner end of a second link of the other X configured truss structure of the pair;

means for releasably fixing at least one of said slider members in a position to maintain said shelter in an erected condition;

a canopy supported by said legs and leg connected truss structures;

at least one pair of X configured central support truss structures, each X configured central support truss structure having:

a first central link having:

an outer end pivotally connected to inner ends of said first links of a pair of said X configured truss structures; and a center portion; and an inner end pivotally connected to an inner end of the first central link inner end of the other X configured central support truss structure of the pair; and a second central link having:

an outer end pivotally connected to adjacent inner ends of said second links of a pair of said X configured truss structures;

a center portion pivotally connected to said center portion of the first central link of the X configured central support structure; and an inner end pivotally connected to an inner end of the second central link inner end of the other X configured central support truss structure of the pair.

2. The shelter as defined in claim 1 wherein said at least one pair of X configured central support truss structures include:

central canopy support means pivotally connected to said inner ends of said first and second central links of a pair of X configured central support truss structures.

3. The shelter as defined in claim 2 having:

four telescoping legs, said central canopy support means being positioned equidistant from said four telescoping legs.

4. The shelter as defined in claim 3 wherein said first and second links have the same distance between said inner and outer ends thereof.

5. The shelter as defined in claim 2 wherein said pair of X configured central support truss structures and at least two pairs of said X configured truss structures are parallel to each other and perpendicular to at least two other pairs of said X configured truss structures when said shelter is in an erected condition.

6. The shelter as defined in claim 5 wherein said pair of X configured central support truss structures and said pairs of said X configured truss structures are perpendicular to said telescoping legs.

7. A collapsible shelter which can be quickly erected including:

four or more telescoping legs, each having:

an upper portion;

a slider member connected to said upper portion for sliding contact therewith; and a lower portion for engagement with the ground slideably mounted to said upper portion;

truss structures connecting adjacent legs with each truss structure comprised of multiple pairs of X-shaped truss assemblies with each assembly including a pair of structural members which are pivoted together at their midpoints to form an X and are pivotally connected to another pair of pivotally connected X members at inner ends thereof, the upper outer ends of the structural members of each pair being connected pivotally to an upper portion of a respective adjacent leg and the resultant lower ends are each pivotally connected to a respective slider member of a respective adjacent leg;

means for maintaining said slider members in positions to maintain the shelter in an erected position;

a canopy supported by said legs and leg connected truss structures; and at least one central truss structure, each central truss structure having:

a pair of X-shaped central truss assemblies connected to each other, each X-shaped central truss assembly including:

a pair of central structural members which are pivoted together at their midpoints to form an X, are pivotally connected at inner ends thereof to inner ends of said pair of central structural members of the other of said pair of X-shaped central truss assemblies, and are connected at outer ends thereof to inner ends of said structural members.

8. A collapsible shelter which can be quickly erected including:

at least four telescoping legs, each telescoping leg having:

an upper portion;

a slider member connected to said upper portion for sliding contact therewith;

a lower portion for engagement with the ground, said lower portion being slideably mounted to said upper portion; and first releasable locking means for maintaining said upper and lower portions in an extended condition;

at least four pairs of X configured truss structures, each X configured truss structure of each pair of X configured truss structures having:

a first link having:

an outer end pivotally connected to a leg upper portion;

a center portion; and an inner end pivotally connected to an inner end of said first link inner end of another X configured truss structure of the pair; and a second link having:

an outer end pivotally connected to a slider member;

a center portion pivotally connected to said center portion of said first link of said X configured truss structure; and an inner end pivotally connected to an inner end of a second link of the other X configured truss structure of the pair;

means for releasably fixing at least one of said slider members in a position to maintain said shelter in an erected condition including:

second releasable locking means for maintaining said upper portion of at least one telescoping leg and the slider member connected thereto in a shelter erecting position; and a canopy supported by said legs and leg connected truss structures.

9. The shelter as defined in claim 8 wherein said first releasable locking means of each telescoping leg include:

a leg abutment member biased outwardly;

an abutment orifice in said lower portion through which said leg abutment member extends; and an abutment orifice in said upper portion through which said leg abutment member can extend to maintain said abutment orifices in alignment and to maintain said upper and lower portions of the telescoping leg in an extended condition.

10. The shelter as defined in claim 9 wherein said second releasable locking menas for maintaining said upper portion of at least one telescoping leg and the slider member connected thereto in a shelter erecting position include:

a slider abutment member biased outwardly;

an abutment orifice in said upper portion through which said slider abutment member extends; and an abutment orifice in said slider member through which said abutment member can extend to maintain said abutment orifices in alignment and to maintain said upper portion of the telescoping leg and said slider member in a shelter erecting position.

11. The shelter as defined in claim 10 further including:

at least one pair of X configured central support truss structures, each X configured central support truss structure having:

a first central link having:

an outer end pivotally connected to inner ends of said first links of a pair of said X configured truss structures;

a center portion; and an inner end pivotally connected to an inner end of the first central link inner end of the other X configured central support truss structure of the pair; and a second central link having:

an outer end pivotally connected to adjacent inner ends of said second links of a pair of said X configured truss structures;

a center portion pivotally connected to said center portion of the first central link of the X configured central support structure; and an inner end pivotally connected to an inner end of the second central link inner end of the other X configured central support truss structure of the pair.

12. The shelter as defined in claim 11 wherein said at least one pair of X configured central support truss structures include:

central canopy support means pivotally connected to said inner ends of said first and second central links of a pair of X configured central support truss structures.

13. The shelter as defined in claim 12 having:

four telescoping legs, said central canopy support means being positioned equidistant from said four telescoping legs.

14. The shelter as defined in claim 13 wherein said first and second links have the same distance between said inner and outer ends thereof.

15. The shelter as defined in claim 12 wherein said pair of X configured central support truss structures and at least two pairs of said X configured truss structures are parallel to each other and perpendicular to at least two other pairs of said X configured truss structures when said shelter is in an erected condition.

16. The shelter as defined in claim 15 wherein said pair of X configured central support truss structures and said pairs of said X configured truss structures are perpendicular to said telescoping legs.

17. The shelter as defined in claim 16 wherein said upper and lower portions of each of said telescoping legs have circular cross sections and said lower portion nests in said upper portion.

18. The shelter as defined in claim 16 wherein said upper and lower portions of each of said telescoping legs have generally rectangular cross sections and said lower portion nests in said upper portion.

19. A collapsible canopy shelter adapted to be positioned on the ground, comprising:

a plurality of upright corner support members each having a top and bottom and oriented to define vertical edges of a selected geometric configuration, a slide bracket slideably mounted on each of said corner support members and moveable therealong, an edge scissor assembly interconnecting adjacent ones of said corner support members, each respective edge scissor assembly oriented in a generally vertical plane and having one portion being pivotally secured to the top of its associated corner support members and another portion being pivotally secured to the slide brackets of its associated corner support members, said edge scissor assemblies operative to expand and contract whereby its associated corner support members are caused to move away from and toward one another to vary the dimensions of said geometric configuration, said canopy shelter being in an expanded position when said corner support members are moved away from one another and in a collapsed position when said corner support members are moved toward one another, an internal scissor assembly extending across said geometric configuration and connected between at least two of said edge assemblies and operative to expand and contract in response to expansion and contraction of said edge scissor assemblies, first releasable latch means on each said corner support members for releaseably retaining its respective slide bracket adjacent the top of its respective corner support member to retain said canopy shelter in the expanded position, a flexible covering extending across the tops of said corner support members and sized to cover the upper surface of said geometric configuration when said canopy shelter is in the expanded position, and an upright interior post secured to the internal scissor assembly and operative to positively support a central portion of said flexible covering when said canopy shelter is in the expanded position.

20. A collapsible canopy shelter adapted to be erected on the ground at a desired location, comprising:

four upright corner support members defining a parallelepiped, each corner support member having a top section and a bottom ground-engaging end, a slide bracket slideably received on each corner support member and moveable therealong, an edge scissor assembly interconnecting adjacent ones of said corner support members whereby two pairs of facing scissors assemblies are formed, each said edge scissor assembly oriented in a generally vertical plane and interconnecting the slide brackets and the top sections of its associated corner support members and operative to move its respective corner support members away from one another into an expanded position when its said slide brackets are moved toward the tops of their respective corner support members and to move its respective corner support members toward one another in a collapsed position when its said slide brackets are moved toward the bottom ends of their respective corner support members, an internal scissor assembly extending between and connected to at least one pair of facing scissors assemblies and operative to expand and contract in response to expansion and contraction of said one pair of facing scissors assemblies, releaseable latch means on each said corner support member for releaseably retaining its respective slide bracket at a location corresponding to the expanded position, a flexible covering sized to extend across the top sections of said corner support members when they are in the expanded position to define a top surface of said parallelepiped, and an upright interior post engaged with and supported by said interior scissor assembly whereby the expansion of the internal scissor assembly allows said interior post to be positioned to positively support a central portion of flexible covering against the internal scissor assembly when said canopy shelter is in the expanded position.

21. A collapsible canopy shelter according to claim 20, and further including:

post means supported by said internal scissor assembly for supporting a center portion of said flexible covering, and wherein:

said edge scissor assemblies are each defined by at least two X-shaped scissor units, each scissor unit comprising first and second elongated arms hinged together at their mid-sections, said units being pivotally connected to one another in end-to-end relation, and at least one pair of facing scissor assemblies being interconnected by an internal scissor assembly.

* * * * *